US008528253B2

(12) United States Patent
Ropelato

(10) Patent No.: US 8,528,253 B2
(45) Date of Patent: Sep. 10, 2013

(54) PROTECTION SYSTEM FOR MOTORIZED PEDESTRIAN ACCESS PASSAGEWAYS

(75) Inventor: Tomaso Ropelato, Trento (IT)

(73) Assignee: Gunnebo Entrance Control S.p.A., Lavis-Trento (IT)

( * ) Notice: Subject to any disclaimer, the term of this patent is extended or adjusted under 35 U.S.C. 154(b) by 1110 days.

(21) Appl. No.: 12/087,190

(22) PCT Filed: Jan. 16, 2007

(86) PCT No.: PCT/EP2007/000374

§ 371 (c)(1),
(2), (4) Date: Jun. 26, 2008

(87) PCT Pub. No.: WO2007/082725

PCT Pub. Date: Jul. 26, 2007

(65) Prior Publication Data

US 2009/0025295 A1 Jan. 29, 2009

(30) Foreign Application Priority Data

Jan. 20, 2006 (IT) ..... VI2006A0022

(51) Int. Cl.
*E06B 11/08* (2006.01)

(52) U.S. Cl.
USPC ..... 49/49

(58) Field of Classification Search
USPC ..... 49/46, 49, 226, 227, 232
See application file for complete search history.

(56) References Cited

U.S. PATENT DOCUMENTS

| | | | | | |
|---|---|---|---|---|---|
| 220,624 | A | * | 10/1879 | Jorgensen | 49/49 |
| 250,693 | A | * | 12/1881 | Van Leiw | 49/233 |
| 3,079,711 | A | * | 3/1963 | Turner | 49/49 |
| 3,169,329 | A | * | 2/1965 | Powers | 49/35 |
| 3,478,467 | A | * | 11/1969 | May | 49/35 |
| 3,606,698 | A | * | 9/1971 | Tenaka | 49/35 |
| 3,633,311 | A | * | 1/1972 | Ulmann | 49/35 |
| 3,654,732 | A | * | 4/1972 | Schacht | 49/127 |
| 3,742,647 | A | * | 7/1973 | Tomita | 49/35 |
| 4,583,619 | A | * | 4/1986 | Fry | 186/59 |
| 4,736,641 | A | * | 4/1988 | Reid | 74/103 |

(Continued)

FOREIGN PATENT DOCUMENTS

| | | | |
|---|---|---|---|
| EP | 0 644 309 A1 | | 3/1995 |
| IT | 0644309 | * | 3/1995 |

OTHER PUBLICATIONS

Rectifier,Sep. 13, 2011, Wikipoedia Foundation, Inc.*
PCT Search Report dated May 8, 2007.

(Continued)

*Primary Examiner* — Katherine Mitchell
*Assistant Examiner* — Justin Rephann
(74) *Attorney, Agent, or Firm* — Hedman & Costigan, P.C.; James V. Costigan; Kathleen A. Costigan

(57) ABSTRACT

A protection system for motorized pedestrian access passageways, comprising a mechanism for the closing or opening of said passageways, suitable for activating at least one sliding and oscillating shutter (12), which emerges from and re-enters, respectively, the interior of at least one seat (25) of a shaped structure positioned to the side of the access passageway; the shutter (12) is fixed to a longitudinal covering strip (17) which is thus entrained along the seat (25), by means of side guides (9, 10), so as to inhibit access to the seat (25) when the shutter (12) is in a position which closes the passageway.

5 Claims, 3 Drawing Sheets

(56) References Cited

U.S. PATENT DOCUMENTS

| | | | | |
|---|---|---|---|---|
| 5,012,612 | A * | 5/1991 | Kille | 49/254 |
| 5,369,912 | A * | 12/1994 | Ginzel et al. | 49/141 |
| 5,615,520 | A * | 4/1997 | McGuire | 49/237 |
| 5,659,999 | A * | 8/1997 | Benson | 49/404 |
| 6,450,404 | B1 * | 9/2002 | Imazuka | 235/381 |
| 6,484,784 | B1 * | 11/2002 | Weik et al. | 160/7 |
| 7,617,974 | B2 * | 11/2009 | Vandyck et al. | 235/382 |
| 7,744,035 | B2 * | 6/2010 | Saint-Jalmes et al. | 244/129.5 |
| 7,963,069 | B2 * | 6/2011 | Ropelato | 49/49 |
| 2001/0042346 | A1 * | 11/2001 | Brioschi | 49/447 |
| 2006/0101716 | A1 * | 5/2006 | Vandyck et al. | 49/35 |
| 2010/0223850 | A1 * | 9/2010 | Chen | 49/49 |

OTHER PUBLICATIONS

PNG serie 380: portillon non gargiennee, Oct. 22, 2003 Automatic Systems, WAVRE (XP002430599).

* cited by examiner

Fig. 2
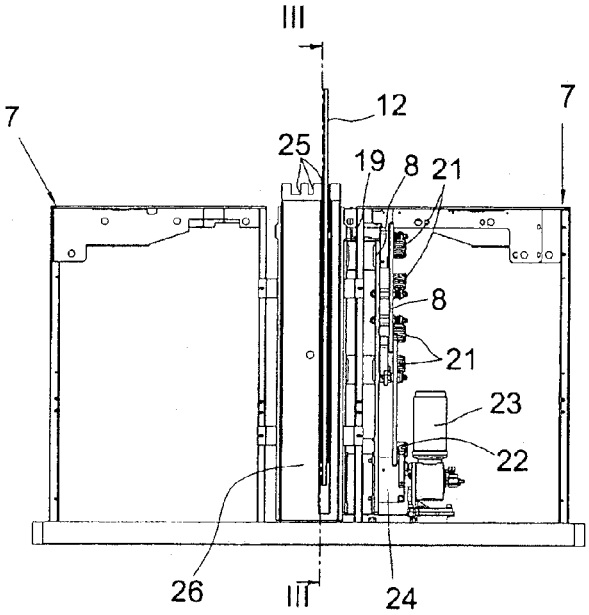
Fig. 3
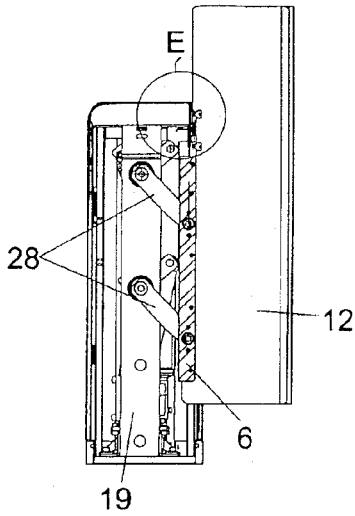
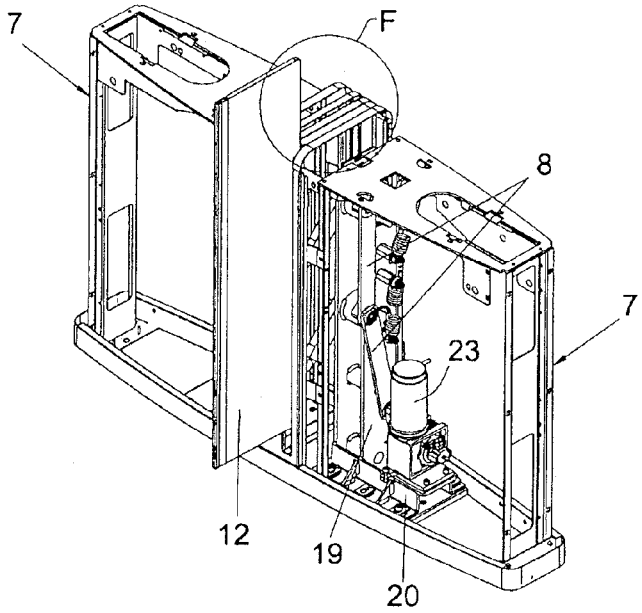
Fig. 1

PROTECTION SYSTEM FOR MOTORIZED PEDESTRIAN ACCESS PASSAGEWAYS

The present invention relates in general to a protection system for motorized pedestrian access passageways, such as those used for controlling the passage of people in places such as subways, airports, factories, offices, etc.

More specifically, the invention relates to a protection device for the sliding openings of oscillating shutters, which normally close said access passageways, suitable for covering said openings when the shutter is moved to close the access passageway.

Motorized access passageways of the traditional type use a mechanism, activated by an alternate or direct current electric motor and relative power transformer, which supports the shutter and allows it to slide perpendicularly in the passage direction to open or close the passageway.

The movement of the shutter is preferably effected along a circumference arc, centered on the vertical line, so that the anticlockwise rotation of the electric motor allows the complete opening of the passageway, by the re-entry of the shutter itself, whereas the closing of the passageway is obtained with the clockwise rotation of the motor, through the exit of the shutter.

The activating logic of traditional movement devices varies according to the specific application and envisages the possibility of opening the passageway normally closed, after appropriate activation (as in the case of subways), or closing the passageway normally open, in the case of the detection of an error condition (for example, in access passageways connected to a metal detector).

As already mentioned, these operations are effected as a result of an oscillating movement, according to which the shutter respectively moves downwards and re-enters the interior of a longitudinal seat of a specific structure, in order to allow the opening of the access passageway, and upwards, emerging from the above longitudinal seat, to allow the closing of the access passageway.

In order to comply with the safety regulations of pedestrian access passageways, however, the absence of any type of opening and/or seat in general is increasingly requested, as these can represent an evident danger for the users, above all during the automatic movement phase of the shutter.

An objective of the present invention is therefore to overcome the above drawbacks and, in particular, to provide a protection system for motorized pedestrian access passageways, which allows the passage of people under substantial safety conditions, avoiding accidents which can occur through the inexperience of the users.

A further objective of the present invention is to provide a protection system for motorized pedestrian access passageways, which also has antivandalism properties, in any case preventing the passage of people under control conditions of the passageway.

Another objective of the invention is to provide a protection system for motorized pedestrian access passageways, which is extremely practical, safe, functional and reliable, as well as economical, in terms of production and operating costs, also in consideration of the advantages obtained.

These objectives, according to the present invention, are achieved by providing a protection system for motorized pedestrian access passageways, according to claim 1 enclosed.

The system object of the invention advantageously allows an active protection of the longitudinal seat where the sliding shutter is housed under open passageway conditions, when said passageway is closed, following the oscillating translation movement of the closing shutter.

This protection also avoids the accumulation of dust and/or the insertion of objects inside the seat which would jeopardize the opening and closing functioning of the passageway; in this sense, the system in question has important antivandalism characteristics, as it has a strong, solid and functional structure, and is also resistant to attempts at tampering and violation.

Further characteristics and advantages of a protection system for motorized pedestrian access passageways, according to the present invention, will appear more evident from the following illustrative and non-limiting description, referring to the enclosed schematic drawings, in which:

FIG. 1 is a perspective view of a structure of a motorized pedestrian access passageway, in a closed passageway position;

FIG. 2 is a side view of the structure according to FIG. 1;

FIG. 3 is a sectional view along the line III-III of FIG. 2;

Figure 4:
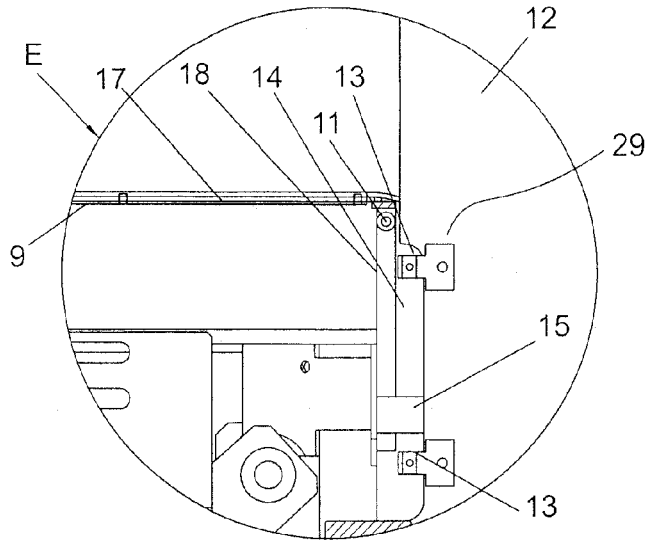
FIG. 4 is an enlarged view of the detail indicated with E in FIG. 3, which illustrates a construction portion of the protection system for motorized pedestrian access passageways, according to the present invention.
Figure 5:
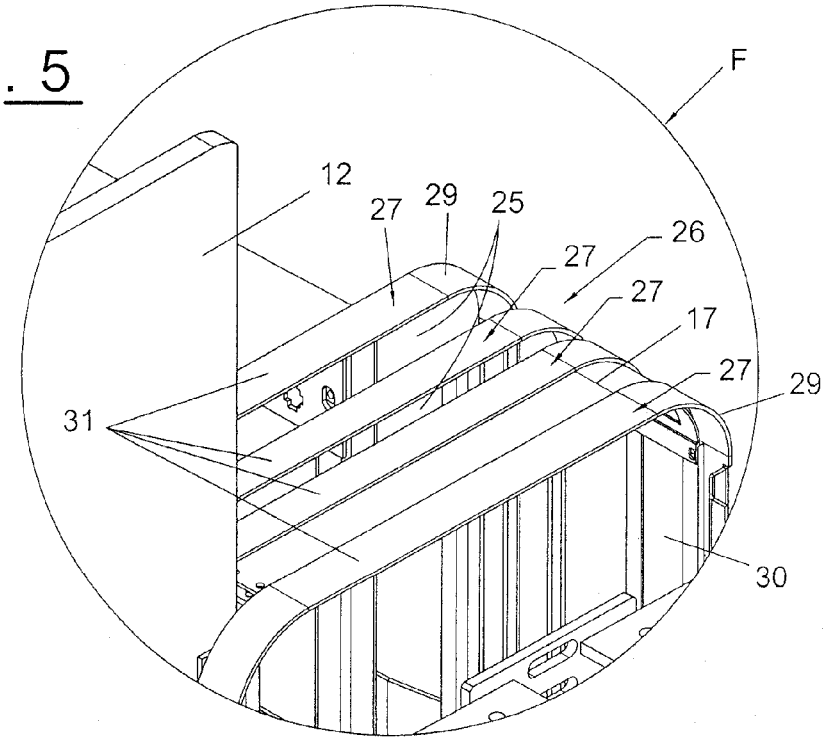
FIG. 5 is an enlarged view of the detail indicated with F in FIG. 1.

With reference to the above figures, a structure, suitable for controlling pedestrian access passageways, such as that shown in FIG. 1, generally has an outer shaped framework 7, positioned to the side of the access passageway and in which a movement and supporting mechanism is installed, of at least one oscillating shutter 12 (normally consisting of simple shaped and tempered glass), which is fixed to the supporting rod 6.

The movement and supporting mechanism of the oscillating shutter 12 envisages a jointed system consisting of a series of rods and/or levers 8 and a pair of movement arms 28, hinged to the supporting rod 6 of the sliding shutter 12.

The levers 8 are centrally hinged on one side of a supporting structure 19, which in turn is fixed onto a base section 20 and, on the opposite side, supports arms 28 which are fitted in correspondence with the fulcra of the levers 8, so as to rotate integrally therewith.

Elastic elements 21 are also envisaged, fixed, in predetermined positions, to the central structure 19 and levers 8, which move in translation, causing the movement of the shutter 12.

This movement is transmitted to the levers 8 by a crank 22, by means of the electric motor 23.

At the base of the structure 19, there is a plate 24, positioned in vertical, which, in correspondence with the upper and lower run-end of the crank 22, carries a stop buffer and a micro-switch (not illustrated in the figures), to reveal the position of the crank 22.

The motor 23 can be of the direct current or alternate current type and incorporates a power transformer.

The particular arrangement of the jointed mechanism described ensures that the movement of the oscillating shutter 12 effects a symmetrical oscillation of the levers 8 and arms 28.

In the position defined in the enclosed FIGS. 1-5, the crank 22 is positioned just before its upper run-end and the shutter 12 is extended almost completely closing the access passageway, whereas the open position of the passageway results from the rotation of the arms 28 to cause the lowering of the oscillating shutter 12, which re-enters one of the guiding seats 25 of the central comb element 26.

According to the present invention, access is inhibited from the outside to each of the above housing seats 25 envisaged in the element 26, in which the respective oscillating shutter 12 re-enters, in an open passageway position, by means of a strip 17, which is moved to cover the relative seat 25 as the oscillating shutter 12 translates into a closed position of the passageway and which, analogously, is moved backwards when the shutter 12 re-enters the housing seat, opening the passageway.

In particular, according to the invention, respective side guides or aisles 9 are created on the inner sides of the shaped parallel elements 27 of the comb element 26, arranged on both the vertical rest portions 30 of the rear of the shutter 12, and also on the facing horizontal portions 31 of the element 26, in addition to respective curved guides or aisles 10, positioned in correspondence with the curvilinear connecting portions 29 between the respective horizontal portions 31 and vertical portions 30.

The guides 9 and 10 allow the covering strip 17 to slide in correspondence with the top of the respective seats 25 of the central comb element 26, so as to totally cover the above seats 25 when the shutter 12 has emerged from the relative seat 25 closing the pedestrian access passageway (FIGS. 1-5).

More specifically, the rear of the oscillating shutter 12 is fixed to the covering strip 17 by means of a rod-shaped hooking support 18, in correspondence with the pin indicated with 11 in FIG. 4, so that the same oscillating shutter 12, during its closing and opening movement of the passageway, causes the entrainment of the strip 17, which can therefore respectively close the seat 25, extending along the whole horizontal portion 31 of each of shaped parallel elements 27, or open the seat 25, in which the shutter 12 is housed with the opening of the access passageway, withdrawing inside the guide 9 situated along the vertical portion 30 of an element 27.

For this purpose, the hooking support 18 is also constrained, by means of a sliding element 15, to a guiding rod 14, fixed by means of supporting elements 13.

The functioning of the protection system for motorized pedestrian access passageways, according to the present invention, is substantially as follows.

Figure 6:
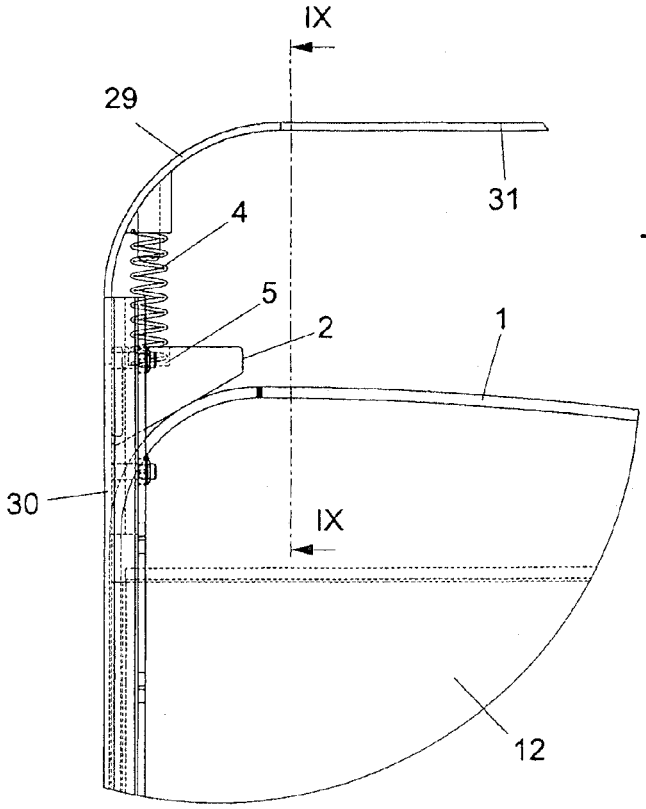
FIG. 6 is a side view of the construction detail according to FIG. 7.
Figure 7:
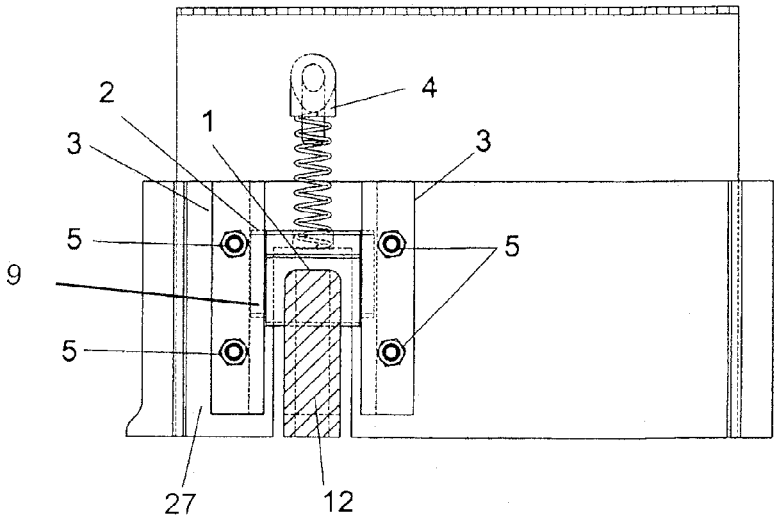
FIG. 7 is a partial sectional view along the line IX-IX of FIG. 8.

Starting from a position of the oscillating shutter 12 inside the respective seat 25 of the element 26, whereby the access passageway is left open, when the above oscillating shutter 12 is moved in translation to close the access passageway, as shown in FIG. 1, the rear portion of the same shutter 12 is lifted, following a swinging movement of the closing shutter 12, entraining with it the covering strip 17 (fixed to the shutter 12 as described above), which is guided inside the aisle 9 and, in particular, between the shaped elements 3 fixed to the portion 30 by means of the fixing elements 5 as shown in FIGS. 6 and 7.

When the closing movement of the sliding shutter 12 causes a lifting of the movement of upper profile 1 of the oscillating shutter 12, it also causes the lifting of and contact with wedge 2. Wedge 2 is interposed with respect to the element 27 by means of an elastic element, such as a spring 4, and in correspondence with which the strip 17 is hooked to the shutter 12.

In this way, as a result of the movement of the supporting and hooking element 18, which moves in a horizontal direction, and the guiding rod 14, which is moved first in a horizontal direction from the support 18 and subsequently in a vertical direction, upon the lifting of the shutter 12 for the closing of the access passageway, each seat 25 is totally covered by the sliding of the strip 17 inside the guides 9, 10.

Finally, numerous other variants can obviously be applied to the protection system in question, all included in the novelty principles inherent in the inventive concept. It is also evident that, in the practical embodiment of the invention, the materials, forms and dimensions of the details illustrated can vary according to requirements and can be substituted with other technically equivalent elements.

The profile 1 of the oscillating shutter 12 also causes the lifting of the wedge 2, which is interposed with respect to the element 27 by means of an elastic element, such as a spring 4, and in correspondence with which the strip 17 is hooked to the shutter 12.

In this way, as a result of the movement of the supporting and hooking element 18, which moves in a horizontal direction, and the guiding rod 14, which is moved first in a horizontal direction from the support 18 and subsequently in a vertical direction, upon the lifting of the shutter 12 for the closing of the access passageway, each seat 25 is totally covered by the sliding of the strip 17 inside the guides 9, 10.

Finally, numerous other variants can obviously be applied to the protection system in question, all included in the novelty principles inherent in the inventive concept. It is also evident that, in the practical embodiment of the invention, the materials, forms and dimensions of the details illustrated can vary according to requirements and can be substituted with other technically equivalent elements.

The invention claimed is:

1. A protection system for motorized pedestrian access passageways, comprising a shaped structure (7) with at least one seat (25) situated to a side of an access passageway, a mechanism for the closing or opening of said access passageway, at least one sliding shutter (12), which moves with an oscillating movement for the closing or opening of the passageway itself, by respectively emerging from or re-entering said at least one seat (25) of said shaped structure (7), wherein said mechanism includes a support rod (6), a lever (8), a crank (22), an activation motor (23) and arms (28) for supporting and activating said sliding shutter (12), said sliding shutter (12) being provided with at least a rod-shaped hooking support (18) to fix said sliding shutter (12) to at least one portion of a longitudinal strip (17) which is entrained by the sliding shutter (12) along said seat (25), said longitudinal strip (17) sliding inside side guides (9, 10) provided in prefixed positions of said shaped structure (7), so as to inhibit access to the seat (25) when the sliding shutter (12) is positioned, to close the access passageway, wherein said sliding shutter (12) is fixed (11) to said longitudinal strip (17) by means of at least a hooking support rod (18), so that said sliding shutter (12) integrally entrains said strip (17) during a closing and opening movement of the passageway, said said hooking support rod (18) being constrained, by means of a sliding element (15), to a guiding rod (14) wherein closing of the sliding shutter (12) causes a lifting of an upper profile (1) of said shutter (12), said upper profile (1) thus contacting a wedge (2), which is interposed with respect to parallel elements (27) of the shaped structure (7), by means of at least one elastic element (4).

2. The protection system according to claim 1, characterised in that said activation motor (23) includes a power transformer, and an outlet shaft that is hinged onto a crank (22), which moves a jointed system consisting of a series of levers and movement arms attached to said shutter (12), where said movement arms rotate integrally with the levers and create a symmetrical oscillation, and a series of elastic elements (21), fixed to said levers, which move in translation.

3. The protection system according to claim 1, characterized in that said shaped structure (7) has a series of said parallel elements (27), arranged parallel to one another, whereby said parallel elements (27) define a series of seats (25).

4. The protection system according to claim 3, characterized in that said side guides (9, 10) are positioned, for at least a prefixed section (29, 30, 31) on the opposite sides of said parallel elements (27), allowing the sliding of the longitudinal strip (17).

5. The protection system according to claim 1, characterised in that, during the movement of said sliding shutter (12) for the closing of the access passageway, said rod-shaped hooking support (18) can be moved in a horizontal direction, whereas said guiding rod (14) can be moved in both a horizontal and vertical direction.

* * * * *